US009321618B2

(12) United States Patent
McIntosh et al.

(10) Patent No.: US 9,321,618 B2
(45) Date of Patent: Apr. 26, 2016

(54) DRIVEN GUIDE SYSTEMS FOR LIFTS

(76) Inventors: David McIntosh, North Vancouver (CA); Steve M. Smith, Vancouver (CA)

( * ) Notice: Subject to any disclaimer, the term of this patent is extended or adjusted under 35 U.S.C. 154(b) by 531 days.

(21) Appl. No.: 13/700,979

(22) PCT Filed: Jun. 3, 2011

(86) PCT No.: PCT/CA2011/050343

§ 371 (c)(1),
(2), (4) Date: Nov. 29, 2012

(87) PCT Pub. No.: WO2011/150525

PCT Pub. Date: Dec. 8, 2011

(65) Prior Publication Data

US 2013/0075679 A1 Mar. 28, 2013

Related U.S. Application Data

(60) Provisional application No. 61/351,040, filed on Jun. 3, 2010.

(51) Int. Cl.

| | |
|---|---|
| ***B66F 7/14*** | (2006.01) |
| ***B66F 7/06*** | (2006.01) |
| ***B66F 7/16*** | (2006.01) |
| ***B66F 7/28*** | (2006.01) |
| *B66F 11/04* | (2006.01) |

(52) U.S. Cl.

CPC . *B66F 7/14* (2013.01); *B66F 7/065* (2013.01); *B66F 7/0608* (2013.01); *B66F 7/16* (2013.01); *B66F 7/28* (2013.01); *B66F 11/042* (2013.01)

(58) Field of Classification Search

CPC ..... B66F 7/14; B66F 7/28; B66F 7/16; B66F 7/08; B66F 7/065; B66F 11/042

See application file for complete search history.

(56) References Cited

U.S. PATENT DOCUMENTS

| | | | | |
|---|---|---|---|---|
| 2,003,581 | A | 6/1935 | Daly, Jr. | |
| 3,820,631 | A * | 6/1974 | King et al. | B66F 11/042 182/141 |
| 4,466,509 | A * | 8/1984 | Kishi | B66F 11/042 182/141 |
| 4,577,821 | A * | 3/1986 | Edmo | B66F 7/08 108/145 |
| 4,930,598 | A | 6/1990 | Murrill et al. | |
| 5,099,950 | A | 3/1992 | Kishi | |
| 5,139,110 | A | 8/1992 | Kishi | |
| 5,431,247 | A | 7/1995 | Kishi | |
| 6,651,775 | B2 | 11/2003 | Bassett, Jr. | |
| 6,679,479 | B1 | 1/2004 | Watkins | |
| 6,974,123 | B2 * | 12/2005 | Latvys | B66F 7/08 254/122 |

(Continued)

*Primary Examiner* — Lee D Wilson
*Assistant Examiner* — Seahee Yoon
(74) *Attorney, Agent, or Firm* — Oyen Wiggs Green & Mutala LLP

(57) ABSTRACT

An apparatus comprising a pair of telescoping arms pivotally coupled between a base and a platform. Each arm comprises a base portion pivotally coupled to the base to pivot about a base pivot axis, an extension portion slidably coupled to the base portion and pivotally coupled to the platform to pivot about a platform pivot axis, and, a pivot support assembly attached along a side of one arm of the pair facing toward the other arm of the pair. The pivot support assembly is configured to allow longitudinal travel of a pivot anchor with respect to the base portion. The pivot assembly is coupled between the pivot anchors. The drive assembly is connected to controllably move the extension portions inwardly and outwardly with respect to the corresponding base portions, and controllably move the pivot anchors toward and away from the corresponding base pivot axes.

34 Claims, 15 Drawing Sheets

(56) References Cited

U.S. PATENT DOCUMENTS 7,093,691 B1 8/2006 Vaughan et al.
2005/0011421 A1 1/2005 Zhang
2008/0185222 A1 8/2008 Herrmann et al.

* cited by examiner

400'

450

400'

400'

400'

DRIVEN GUIDE SYSTEMS FOR LIFTS

REFERENCE TO RELATED APPLICATION

This application claims priority from U.S. Provisional Patent Application Ser. No. 61/351,040, filed 3 Jun. 2010 and entitled "DRIVEN GUIDE SYSTEMS FOR LIFTS". For the purposes of the United States of America, the benefit under 35 U.S.C. §119(e) of this applications is hereby claimed, and this application is hereby incorporated herein by reference.

TECHNICAL FIELD

The invention relates to lifts. Certain embodiments provide driven guide systems for scissor-type lifts.

BACKGROUND

Scissor and other types of lifts are useful for providing elevated platforms for providing workers and equipment access to elevated locations. The load that lifts can safely support is limited by both the vertical force deliverable by the lifting mechanism and the stability of the platform.

There are various types of lifts known in the art. Examples include:

U.S. Pat. No. 3,820,631 to King et al.;
U.S. Pat. No. 4,930,598 to Murrill et al.;
U.S. Pat. No. 5,099,950 to Kishi;
U.S. Pat. No. 5,431,247 to Kishi;
U.S. Pat. No. 6,651,775 to Bassett, Jr.;
U.S. Pat. No. 6,679,479 to Watkins;
U.S. Pat. No. 7,093,691 to Vaughan et al; and,
U.S. Patent Application Publication No. 2008/0185222 to Herrmann et al.

The inventor has determined a need for improved lifts and apparatus for use therewith.

SUMMARY

The following embodiments and aspects thereof are described and illustrated in conjunction with systems, tools and methods which are meant to be exemplary and illustrative, not limiting in scope.

One aspect provides apparatus comprising a pair of telescoping arms pivotally coupled between a base and a platform. Each arm comprises a base portion pivotally coupled to the base to pivot about a base pivot axis, an extension portion slidably coupled to the base portion and pivotally coupled to the platform to pivot about a platform pivot axis, and, a pivot support assembly attached along a side of one arm of the pair facing toward the other arm of the pair. The pivot support assembly is configured to allow longitudinal travel of a pivot anchor with respect to the base portion. A pivot assembly is coupled between the pivot anchors, and a drive assembly connected to controllably move the extension portions inwardly and outwardly with respect to the corresponding base portions, and controllably move the pivot anchors toward and away from the corresponding base pivot axes.

Another aspect provides a lift comprising a base, a platform, and two pairs of telescoping arms pivotally coupled between the base and the platform. Each arm of each pair comprises a base portion pivotally coupled to the base to pivot about a base pivot axis, an extension portion slidably coupled to the base portion and pivotally coupled to the platform to pivot about a platform pivot axis, and, a pivot support assembly attached along a side of one arm of the pair facing toward the other arm of the pair. The pivot support assembly is configured to allow longitudinal travel of a pivot anchor with respect to the base portion. A pivot assembly is coupled between the pivot anchors of each pair of telescoping arms, and a drive assembly connected to controllably move the extension portions inwardly and outwardly with respect to the corresponding base portions, and controllably move the pivot anchors toward and away from the corresponding base pivot axes.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
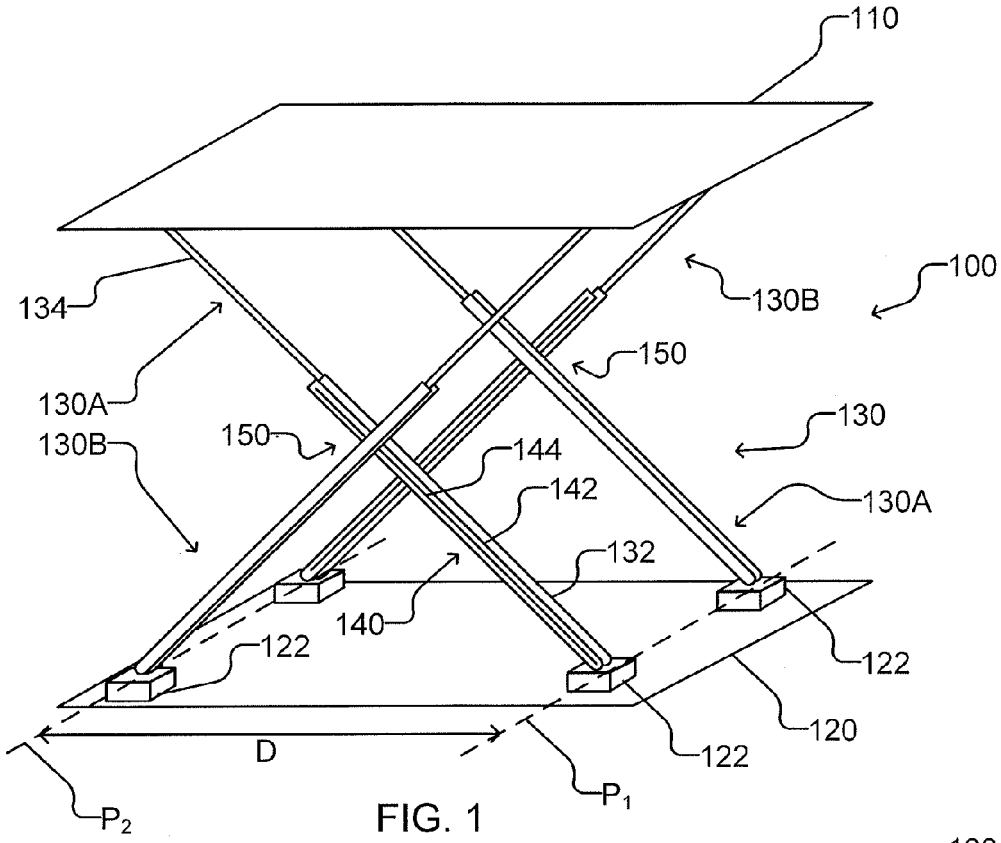
FIG. 1 shows a driven guide assembly according to an example embodiment.
Figure 1A:
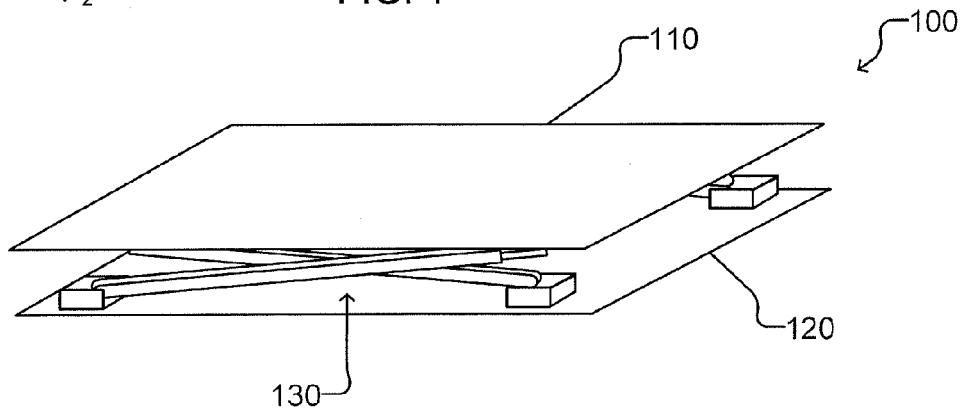
FIG. 1A shows the assembly of FIG. 1 in a lowered position.

FIG. 1 shows a driven guide assembly 100 according to an example embodiment. Assembly 100 is coupled between a platform 110 and a base 120. Assembly 100 comprises two pairs of telescoping arms 130, each pair arranged in an "X" configuration. Each arm 130 is pivotally coupled to fixed locations on platform 110 and base 120 at the upper and lower end thereof, respectively. Each pair of arms 130 is pivotally coupled together by a driven pivot assembly 150. Platform 110 is moveable between a raised position as shown in FIG. 1 and a lowered position as shown in FIG. 1A.

In some embodiments, assembly 100 is configured to provide sufficient lifting force to safely raise, support, and/or lower loads on platform 110. In some embodiments, a primary lifting mechanism (not shown) is also coupled between platform 110 and base 120 to allow lifting and supporting of heavier loads by platform 110. In some situations where no primary lifting mechanism is provided, binding may occur when telescoping arms are at an angle of less than about 10 degrees with respect to base, due to the driving of pivots 150 in nearly opposite directions. In some embodiments, arms 130 are configured to be at an angle of 10 degrees or greater when in the lowered position. In some embodiments one or more biasing mechanisms (not shown) such as, for example, one or more springs, counterweights, levers, airbags, hydraulic cylinders, pneumatic cylinders, etc. may be provided for urging arms 130 upwardly from their lowermost positions to avoid potential binding when arms are inclined at less than about 10 degrees.

In the FIG. 1 example, each telescoping arm 130 comprises a base portion 132 which is pivotally coupled to base 120 by a base hinge 122. An extension portion 134 is slidably coupled to base portion 132. In the illustrated embodiment, extension portion 134 is slidably received in base portion 132. Extension portion 134 is moveable inwardly and outwardly with respect to base portion 132 between an extended position as shown in FIG. 1 and a contracted position as shown in FIG. 1A. A pivot support assembly 140 is attached to each arm 130 on the side thereof which faces the other arm 130 in the pair. Pivot support assembly 140 permits longitudinal movement of pivot assembly 150 along arm 130. A drive assembly (not shown in FIG. 1, see FIG. 2) is connected to control movement of extension portions 134 and pivot assemblies 150 as platform 110 moves up and down. In some embodiments, the drive assembly is configured to move pivots 150 at one half the speed at which it moves extension portions 134.

Figure 1B:
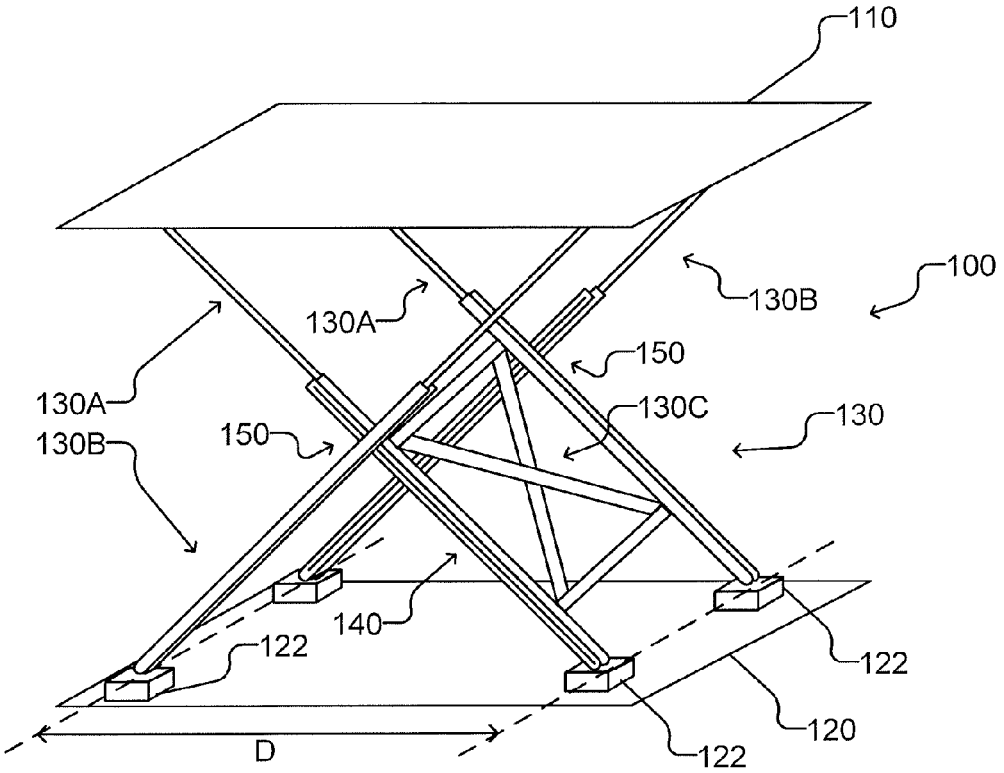
FIG. 1B shows the assembly of FIG. 1 with a truss structure connected between the inner telescoping arms.

Each pair of arms 130 comprises an inner arm 130A and an outer arm 130B. In some embodiments, the inner arms 130A may be connected by a truss structure 130C (see FIG. 1B, not shown in FIG. 1) to provide increased stability. In the FIG. 1 example, the lower ends of inner arms 130A are both coupled to the same end of base 120 and pivot about a common base pivot axis $P_1$, and the upper ends of inner arms 130A are both coupled to the opposite end of platform 110 and also pivot about a common axis. Likewise, the lower ends of outer arms 130B are both connected to the same end of base 120 and pivot about a common base pivot axis $P_2$, and the upper ends of outer arms 130B are both coupled to the opposite end of platform 110 and also pivot about a common axis. The common axes $P_1$ and $P_2$ for the lower ends of inner and outer arms 130A and 130B are separated by a fixed distance D. In some embodiments, the common axes for the uppers ends of inner and outer arms 130A and 130B are vertically aligned with the common axes $P_1$ and $P_2$ for the lower ends, and thus separated by the same distance D.

In some embodiments a primary lifting mechanism is used to raise and lower platform 110 such that the vertical distance between the pivot axes for the lower ends of arms 130 and the pivot axes for the upper ends of arms 130 varies as H(t). In such embodiments, the drive system may be configured to controllably adjust the length of each telescoping arm 130 according to the equation:

$$L(t)=(H(t)^2+D^2)^{0.5}$$

where:

L(t) is the distance between pivot axes of the upper and lower ends of each arm 130; and, D is the distance between the pivot axes $P_1$ and $P_2$ for the lower ends of arms 130.

Figure 2:
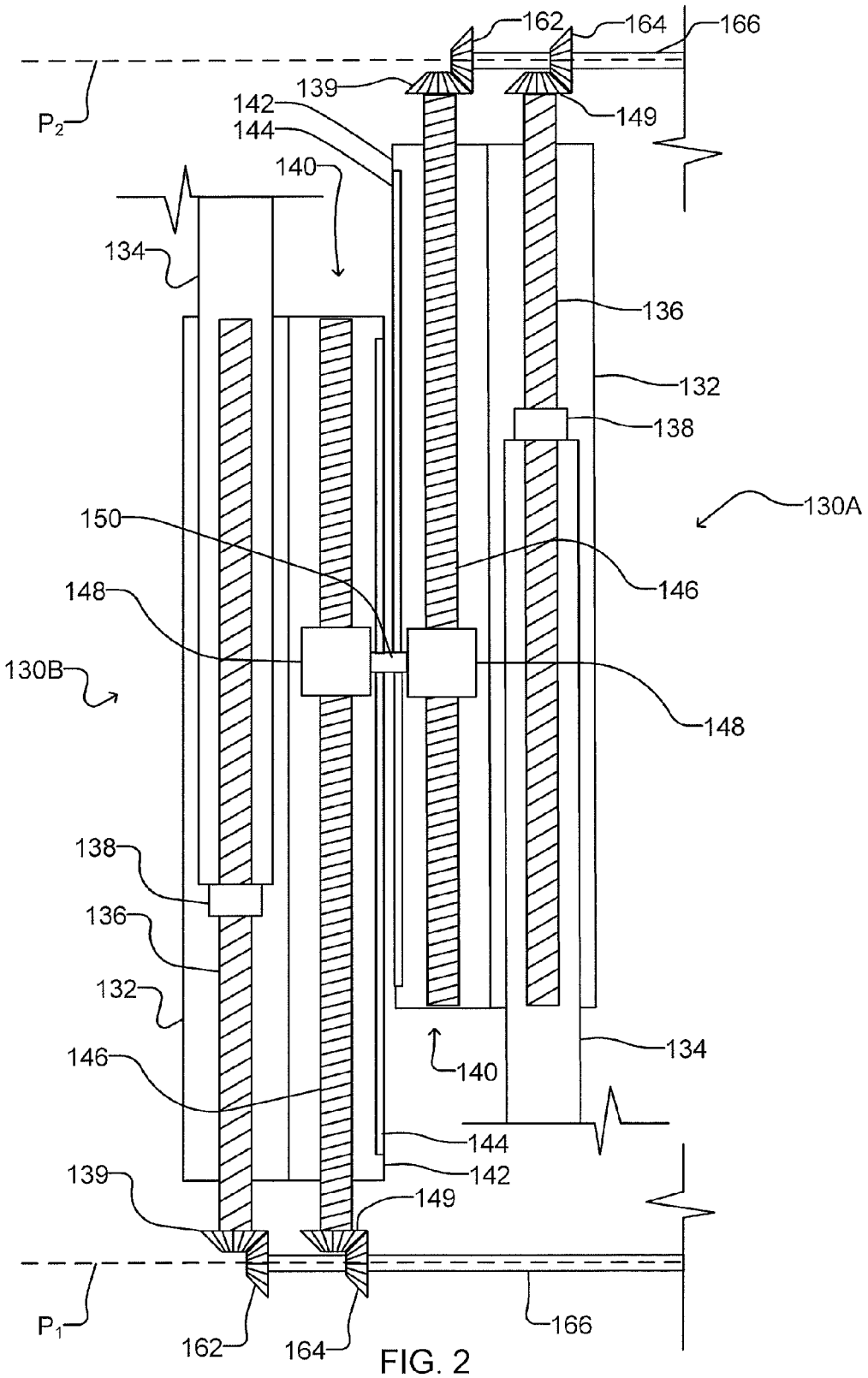
FIG. 2 shows a pair of telescoping arms with a driven pivot according to an example embodiment.

FIG. 2 shows a portion of an example drive assembly for a pair of inner and outer telescoping arms 130A and 130B of the FIG. 1 embodiment. An extension leadscrew 136 extends through base portion 132 and is threadedly received in an extension nut 138 attached to extension portion 134. Extension leadscrew 136 may comprise, for example a ball screw, an Acme screw, or the like. Rotation of extension leadscrew 136 in a first direction causes extension portion 134 to move outwardly with respect to base portion 132. Rotation of extension leadscrew 136 in the opposite direction causes extension portion 134 to move inwardly with respect to base portion 132.

In the illustrated embodiment, pivot support assembly 140 comprises a pivot drive casing 142 attached to the side of base portion 132. Casing 142 has a slot 144 defined along the side thereof opposite base portion 132. A pivot leadscrew 146 extends through pivot drive casing 142 and is threadedly received in a pivot anchor nut 148. Pivot leadscrew 146 may comprise, for example a ball screw, an Acme screw, or the like. Rotation of pivot leadscrew 146 in one direction causes pivot anchor nut 148 to move away from the pivot axis of the lower end of arm 130. Rotation of pivot leadscrew 146 in the opposite direction causes pivot anchor nut 148 to move toward a pivot axis P for the lower end of the corresponding arm 130. Pivot Anchor nuts 148 of inner and outer arms 130A and 130B are pivotally coupled by pivot assembly 150 which extends through slots 144.

Extension and pivot leadscrews 136 and 146 have bevel gears 139 and 149, respectively, attached to the lower ends thereof. In the FIG. 2 example, extension leadscrew 136 has one half as many threads per inch as does pivot leadscrew 146, such that when bevel gears 139 and 149 are driven by corresponding bevel gears 162 and 164 attached to a common shaft 166, extension nut 138 moves at twice the speed of pivot anchor nut 148. Common shaft 166 is driven to rotate about pivot axis P by a motor (not shown), either directly or through further shafts and gears. In some embodiments, a single motor is provided to drive the extension and pivot leadscrews 136 and 146 for all arms 130.

In some embodiments, base and extension portions 132 and 134 of arms 130 have generally circular cross-sections. In other embodiments, base and extension portions 132 and 134 of arms 130 may have generally rectangular cross-sections, generally I-shaped cross sections, or other shapes.

Figure 2A:
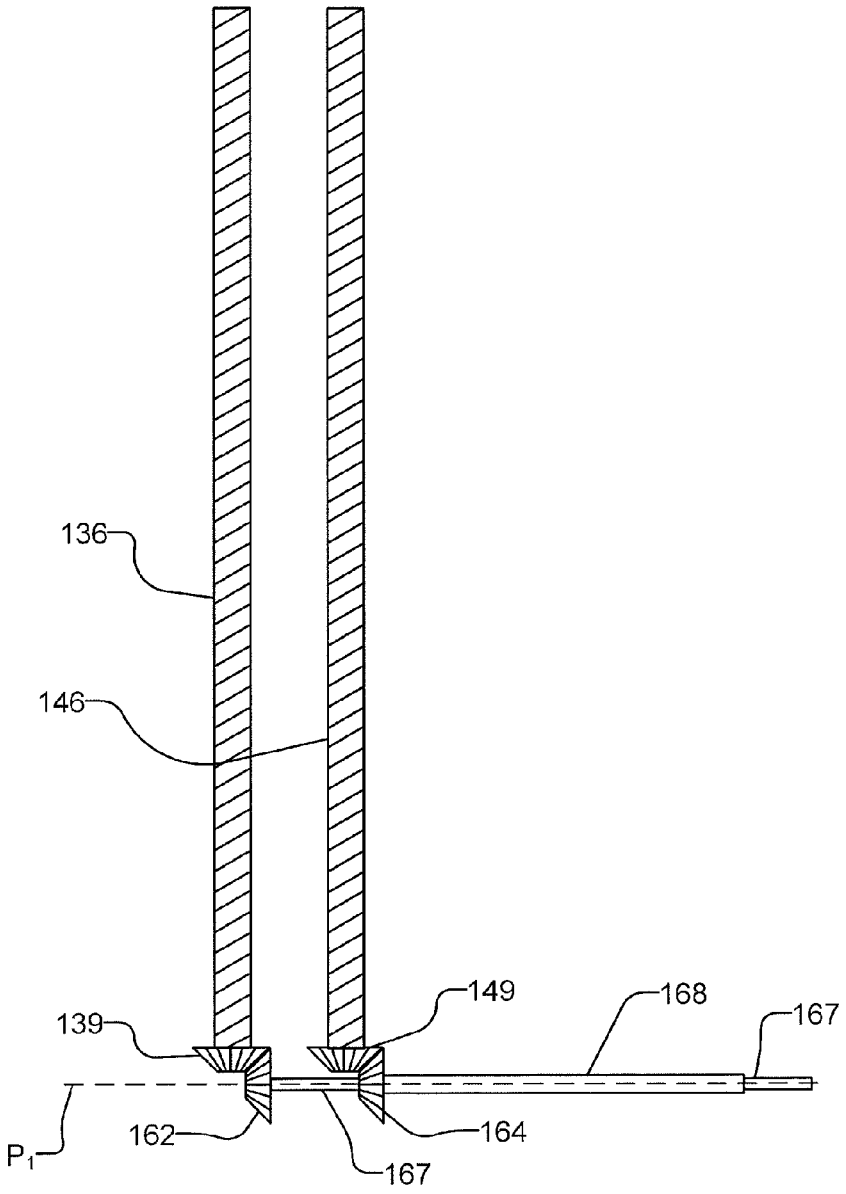
FIG. 2A shows another example drive assembly for the arms of FIG. 2.

FIG. 2A shows another example configuration wherein bevel gears 162 and 164 are attached to concentric shafts 167 and 168, respectively, wherein shaft 167 is rotatable within shaft 168. Shafts 167 are each driven to rotate about pivot axis P. Extension and pivot leadscrews 136 and 146 each have the same number of threads per inch, such that shaft 167 is driven to rotate at twice the rate of shaft 168 to maintain the two to one speed ratio of extension nut 138 to pivot anchor nut 148. Shafts 167 and 168 may be driven by separate motors, or driven by the same motor through appropriate gearing.

Figure 3:
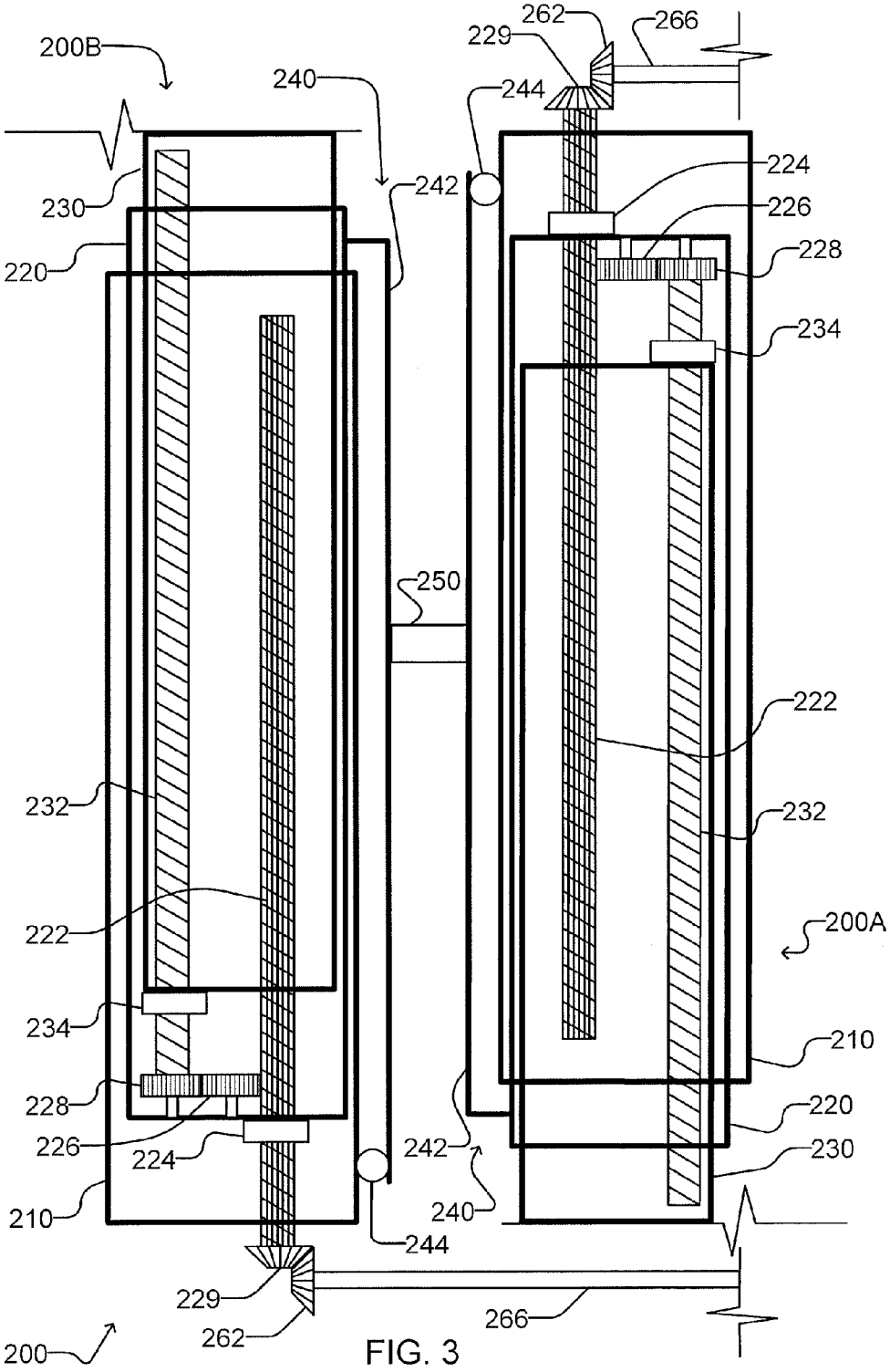
FIG. 3 shows a pair of telescoping arms with a driven pivot according to another example embodiment.

FIG. 3 shows a pair of telescoping arms 200 (individual labeled as inner arm 200A and outer arm 200B) according to another example embodiment. Each arm 200 comprises a base portion 210, a first extension portion 220 and a second extension portion 230. A first extension leadscrew 222 extends through base portion 210 and is threadedly received in a first extension nut 224 attached to first extension portion 220. First extension leadscrew 222 has a plurality of longitudinal slots cut or otherwise formed through the helical threads thereof such that leadscrew 222 has teeth formed therein to engage a spur gear 226 pivotally mounted to a bottom of first extension portion 220. Spur gear 226 in turn engages another supr gear 228 pivotally mounted to the bottom of first extension portion 220. A second extension leadscrew 232 is mounted on spur gear 228 and extends through first extension portion 220 and into second extension portion 230. Second extension leadscrew 232 is threadedly received in a second extension nut 234 attached to second extension portion 220.

A pivot support assembly 240 is attached to the side of first extension portion 220 and extends down along the exterior of base portion 210. In the FIG. 3 example, pivot support assembly 240 comprises a pivot support arm 242 which serves as a pivot anchor and which has a linear bearing 244 at an end thereof to ride along the exterior of base portion 210. Pivot assembly 250 is coupled between pivot support arms 242 of the inner and outer telescoping arms 200A and 200B.

Extension screw 222 has a bevel gear 229 at the end thereof, which is driven to rotate by a corresponding bevel gear 262 attached to a shaft 266 extending through the pivot axis for the lower end of arm 200. Extension screws 222 and 232 have the same number of threads per inch, and are connected through spur gears 226 and 228 to rotate at the same rate, such that first extension 220 (and pivot assembly 250 which is coupled thereto) moves at one half the speed as second extension 230 with respect to base portion 210.

Figure 3A:
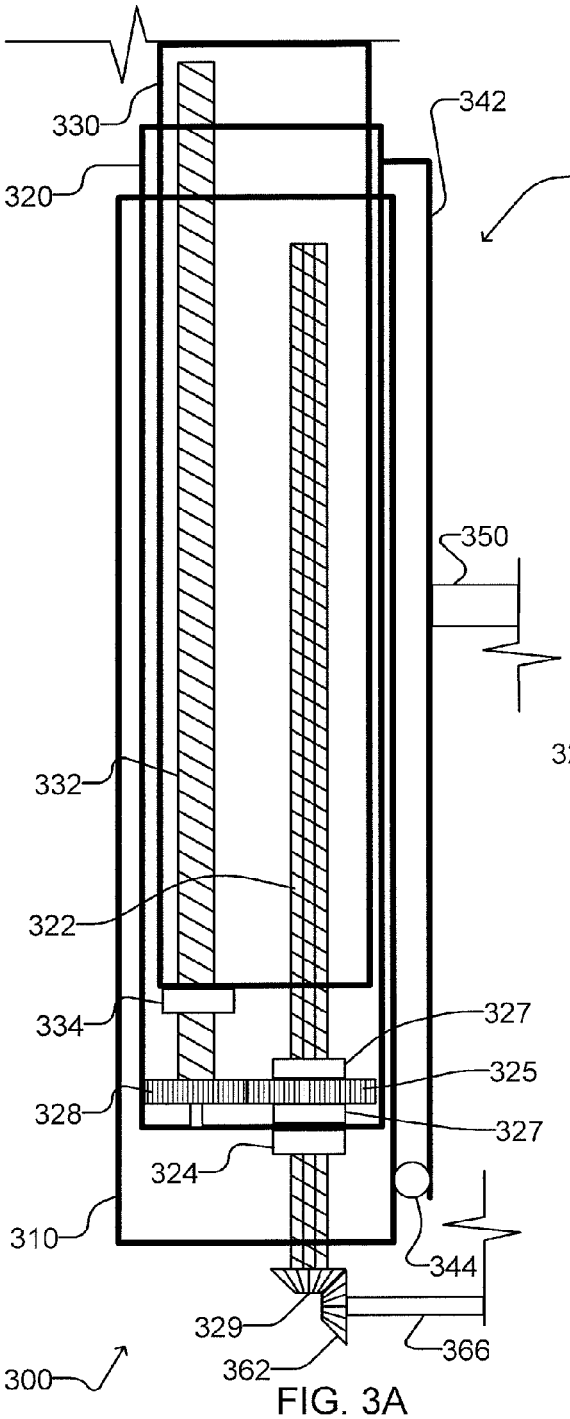
FIGS. 3A-C show another example drive assembly for a telescoping arm.
Figure 3B:
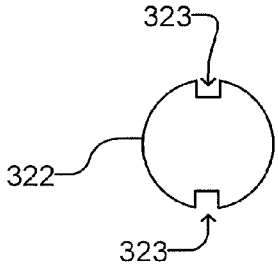
Figure 3C:
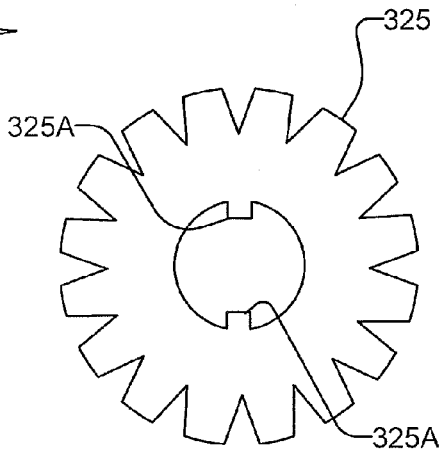

FIG. 3A shows a telescoping arm 300 according to another example embodiment which is similar to arms 200 described above, but with a different drive assembly. Arm 300 comprises a base portion 310, a first extension portion 320 and a second extension portion 330. A first extension leadscrew 322 extends through base portion 210 and is threadedly received in a first extension nut 324 attached to first extension portion 320. As best seen in FIG. 3B, which shows the cross-section of first extension leadscrew 322, first extension leadscrew 322 has a pair of keyways 323 cut or otherwise formed therein. A first extension spur gear 325 having an aperture defined therein (see FIG. 3C) to correspond to the cross-section of first extension leadscrew 322 is slidably mounted on first extension leadscrew 322. As seen in FIG. 3C, first extension spur gear 325 comprises tabs 325A which are slidably received in keyways 323 such that first extension spur gear 325 rotates with first extension leadscrew 322. First extension spur gear 325 in turn engages another supr gear 328 pivotally mounted to the bottom of first extension portion 320. Retaining elements 327 may be provided to hold first extension spur gear 325 at the same level as spur gear 328. A second extension leadscrew 332 is mounted on spur gear 328 and extends through first extension portion 320 and into second extension portion 330. Second extension leadscrew 332 is threadedly received in a second extension nut 334 attached to second extension portion 320.

A pivot support assembly 340 is attached to the side of first extension portion 320 and extends down along the exterior of base portion 310. As in the FIG. 3 example, pivot support assembly 340 of the FIG. 3A example comprises a pivot support arm 342 which serves as a pivot anchor and which has a linear bearing 344 at an end thereof to ride along the exterior of base portion 310. Pivot assembly 350 is coupled between pivot support arms 342 of the inner and outer telescoping arms 300 (only one arm is shown in FIG. 3A).

Extension screw 322 has a bevel gear 329 at the end thereof, which is driven to rotate by a corresponding bevel gear 362 attached to a shaft 366 extending through the pivot axis for the lower end of arm 300. Extension screws 322 and 332 have the same number of threads per inch, and are connected through spur gears 325 and 328 to rotate at the same rate, such that first extension 320 (and pivot assembly 350 which is coupled thereto) moves at one half the speed as second extension 330 with respect to base portion 310.

Figure 4A:
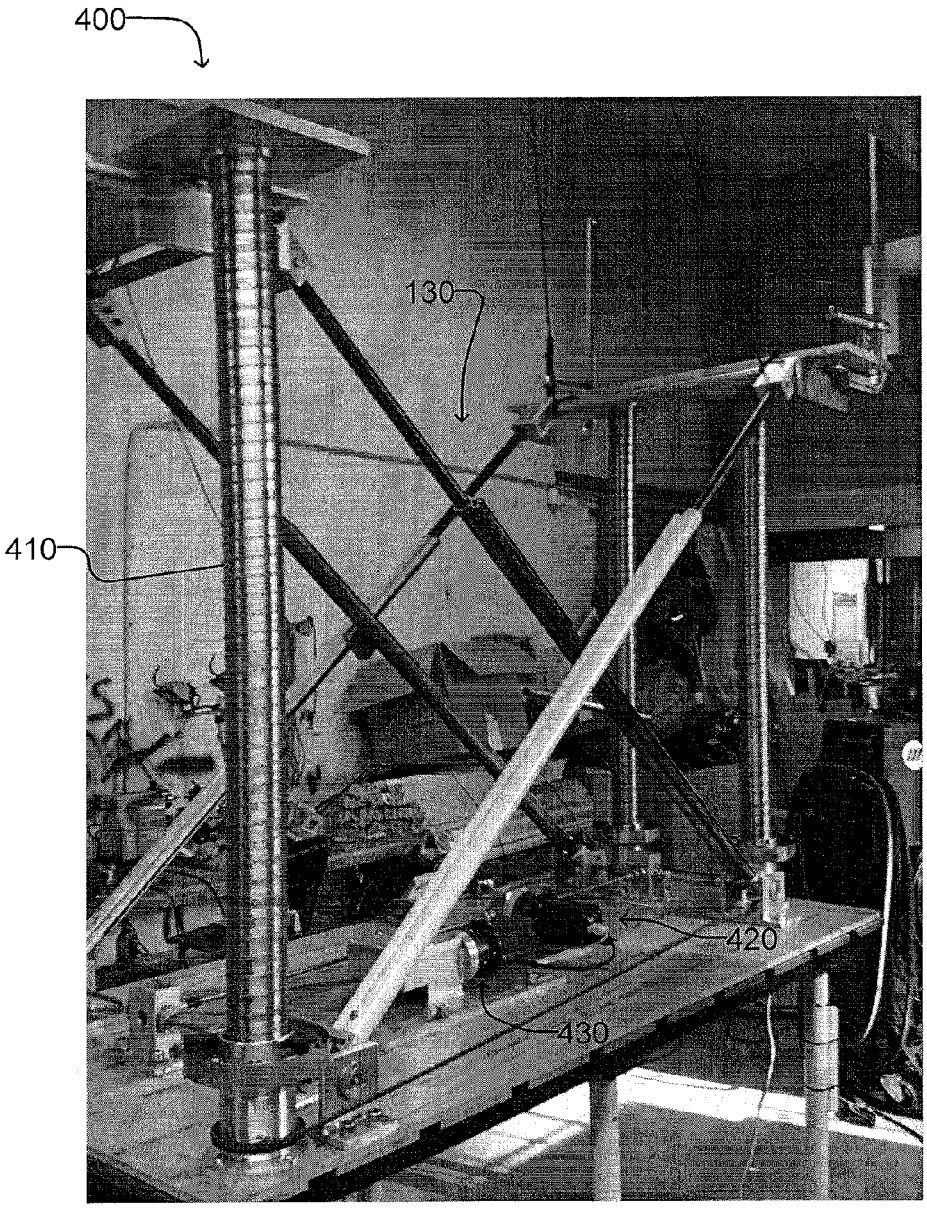
FIGS. 4A-F show a lift assembly according to an example embodiment.
Figure 4B:
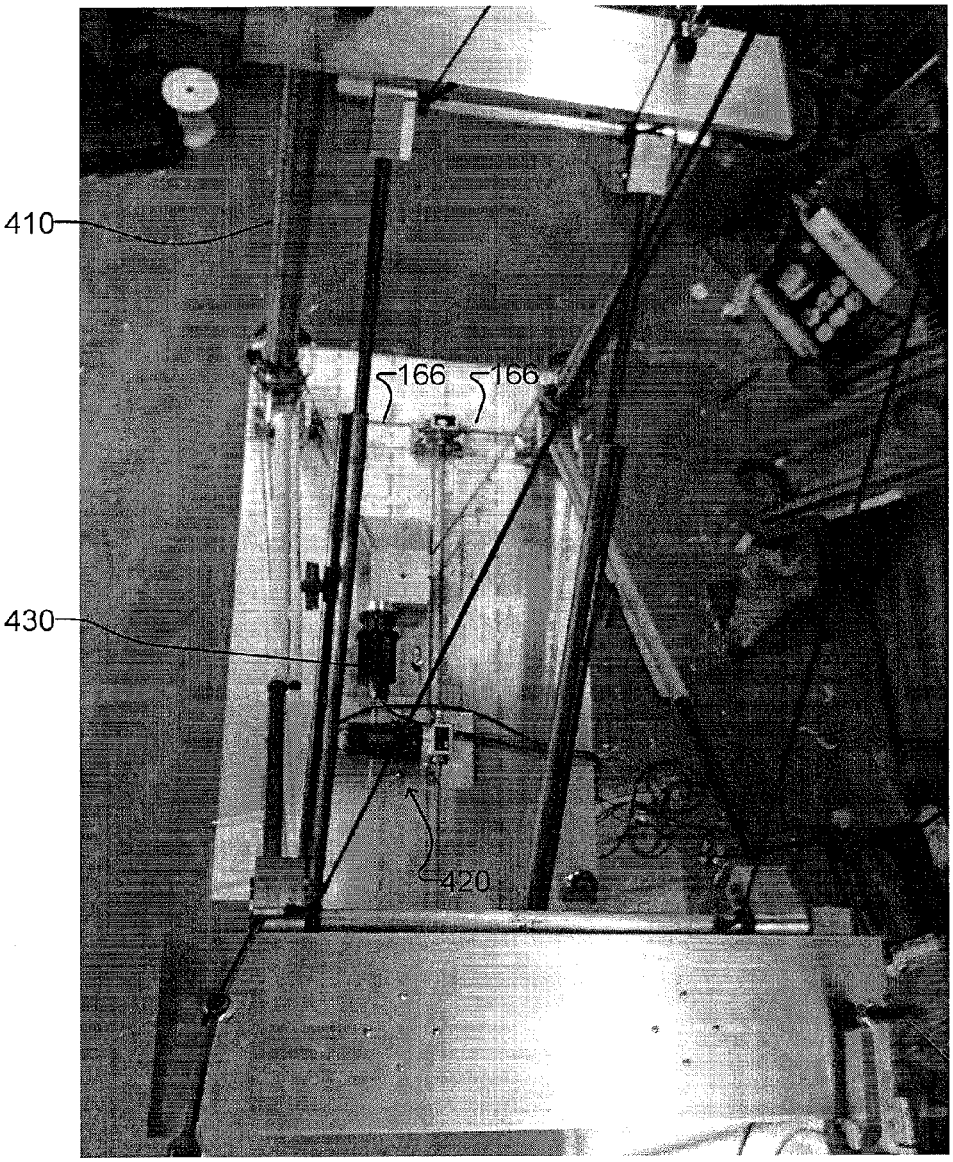
Figure 4C:
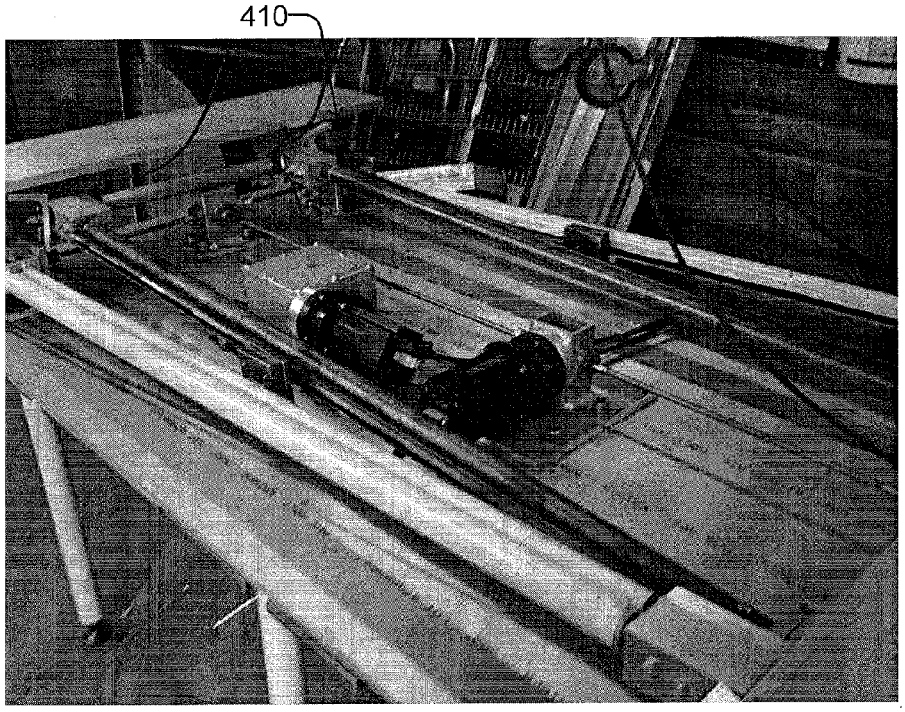
Figure 4D:
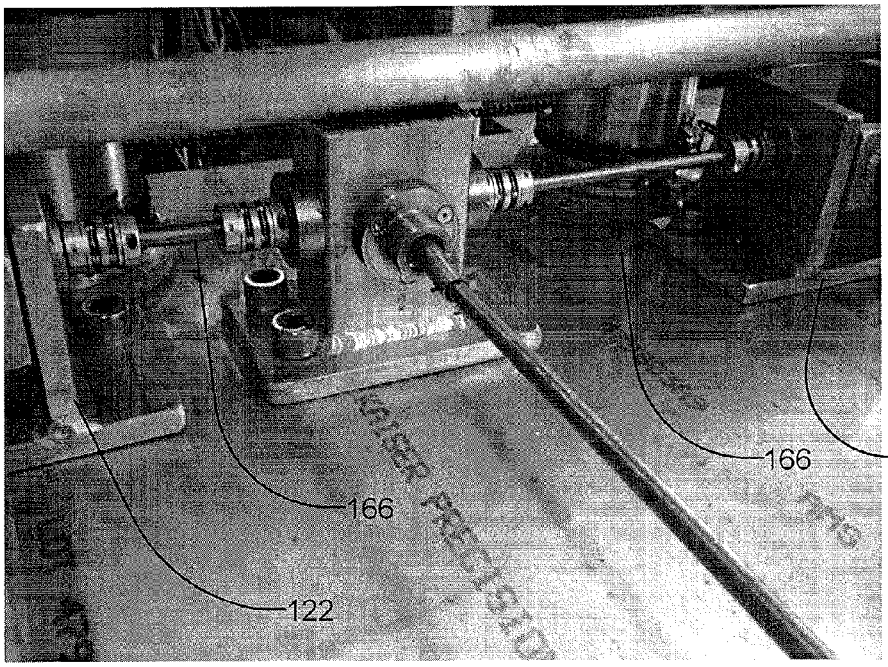

FIGS. 4A-F are photographs of a prototype lift assembly 400 according to an example embodiment. Assembly 400 comprises two pairs of telescoping arms which are substantially similar to arms 130 described above with respect to FIGS. 1 and 2 and will not be described again to avoid repetition. In the example of FIGS. 4A-F, primary lifting mechanisms in the form of four lifting units 410 are provided. In the illustrated example, lifting units 410 comprise coiled flexible flat springs which expand with insertion of a vertically oriented spiral band, such as, for example Spiralifts™ made by PACO Spiralift Inc. of St. Hubert, Quebec, Canada, but other types of lifting units may be used in other embodiments. As shown in FIG. 4C, Spiralift™ lifting units 410 are relatively compact when retracted. The construction and operation of Spiralifts™ are generally described in Appendix "A" attached hereto and at http://www.pacospiralift.com, and the product catalog which is available at http://pacospiralift.com/pdf/Spiralift_catalog.pdf, both of which are hereby incorporated by reference herein. FIG. 4M shows schematically an example lifting mechanism 410 which includes a coiled flexible flat spring 410A and a vertically oriented spiral band 410B.

Assembly 400 comprises a guide motor 420 for driving telescoping arms 130 and a primary lift motor 430 for driving lifting units 410. Guide motor 420 is connected to drive shafts 166 through suitable shafts and gearing (not specifically enumerated). Lift motor 430 is connected to drive lifting units 410 by a chain assembly (not specifically enumerated).

Figure 4E:
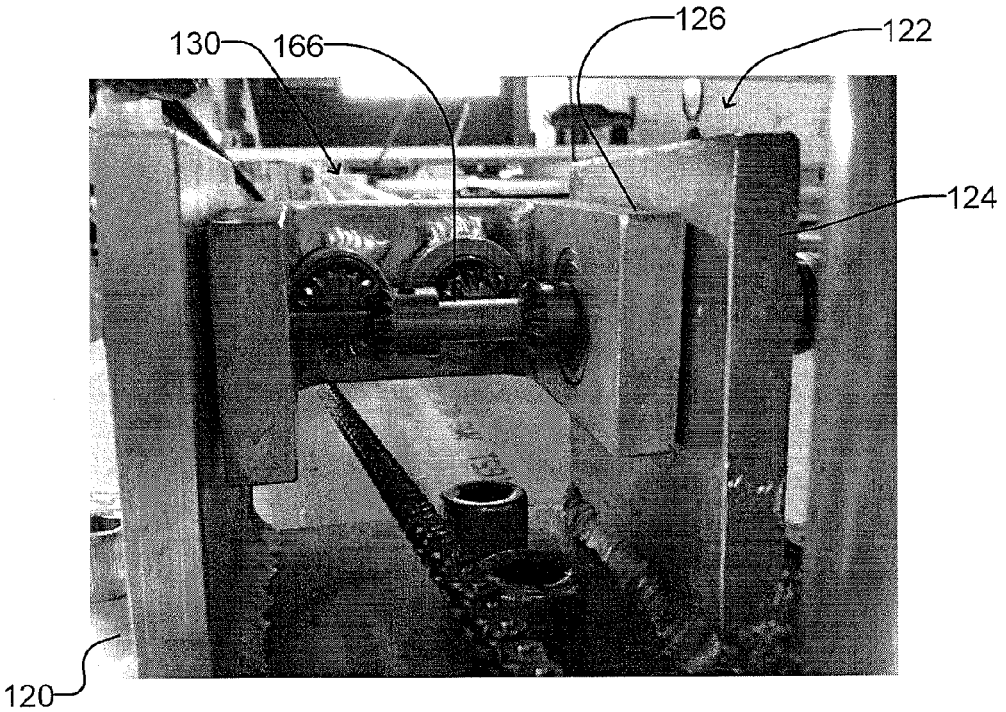

As best seen in FIG. 4E, each base hinge 122 of assembly 400 comprises a pair of tabs 124 extending upwardly from base 120, and a generally U-shaped member 126 pivotally coupled thereto by, for example, bearings or the like, to rotate about an axis through shaft 166. The lower end of telescoping arm 130 is connected to U-shaped member 126.

Figure 4F:
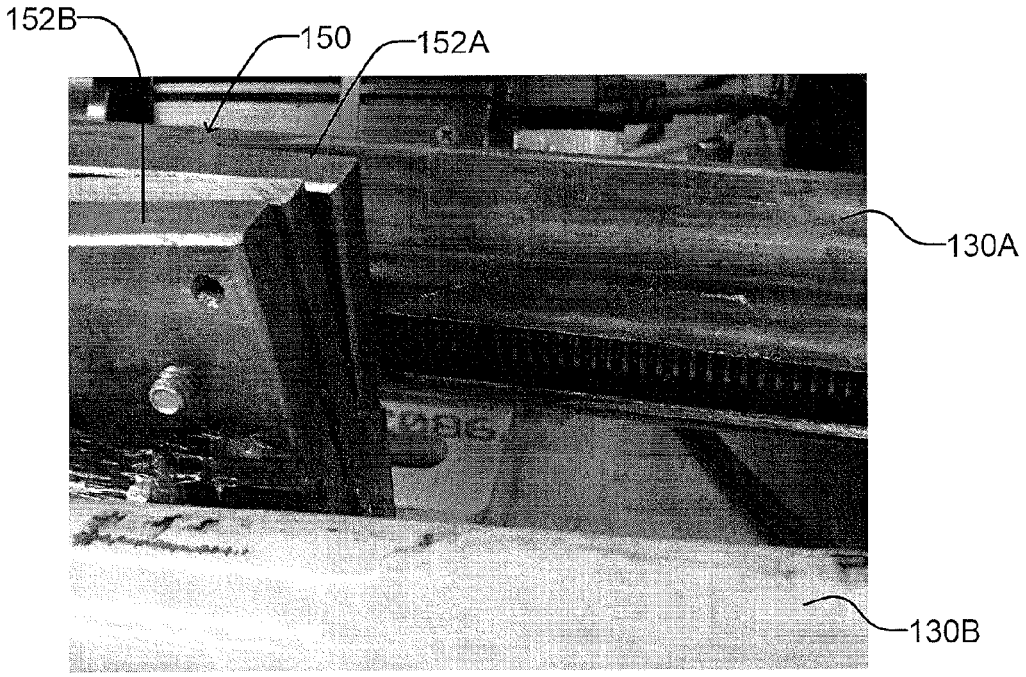
Figure 4H:
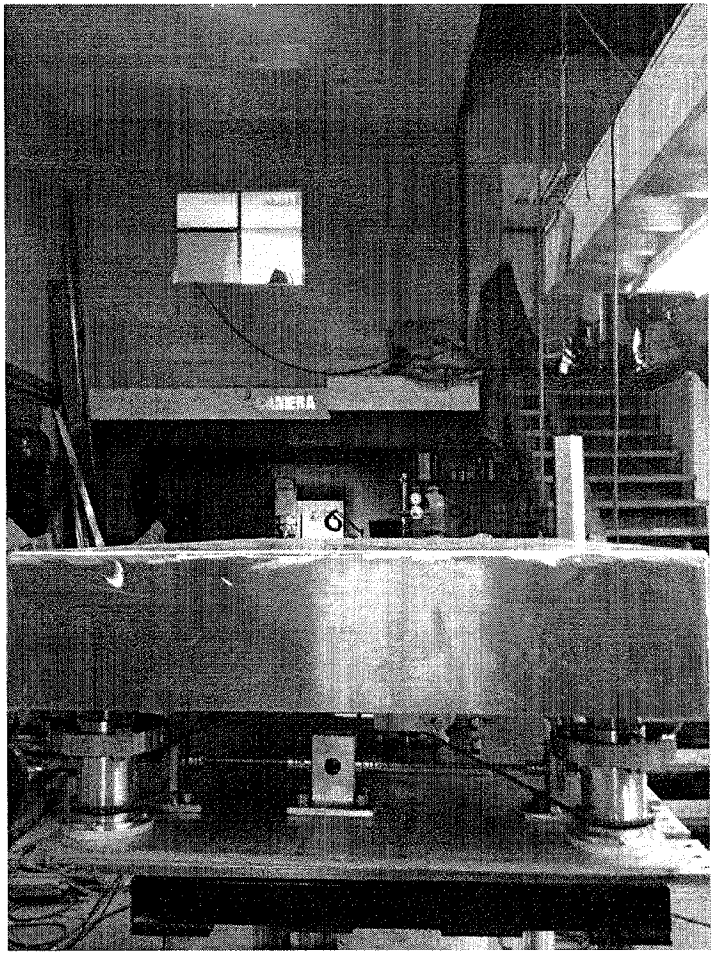
FIGS. 4G-L show movement of another example lift assembly from a lowered position to a raised position.

As best seen in FIG. 4F, each pivot assembly 150 of assembly 400 comprises a pair of pivot plates 152A and 152B respectively connected to the pivot anchors (not shown in FIG. 4F) of the corresponding inner and outer telescoping arms 130A and 130B. Pivot plates 152A and 152B are pivotally coupled together by, for example, bearings or the like.

Figure 4G:
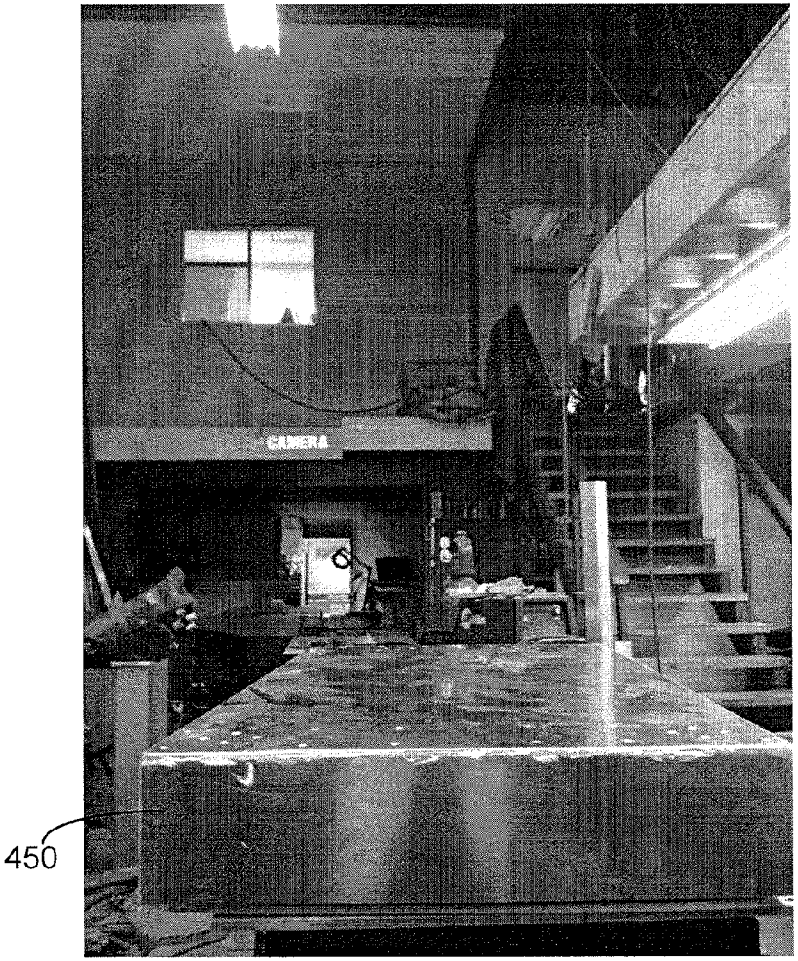
Figure 4J:
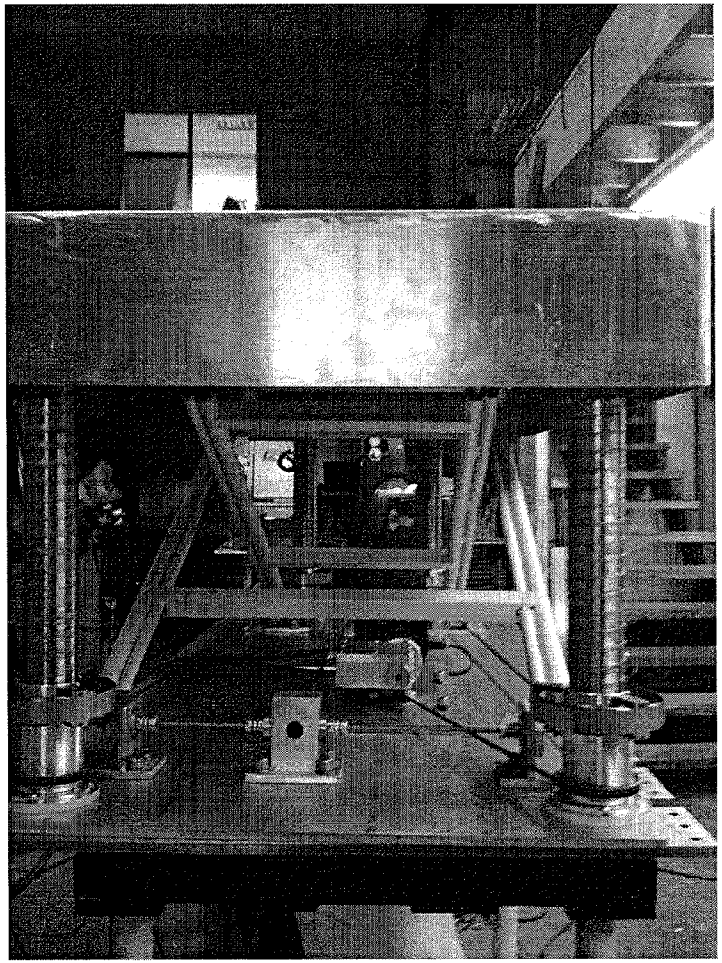
Figure 4I:
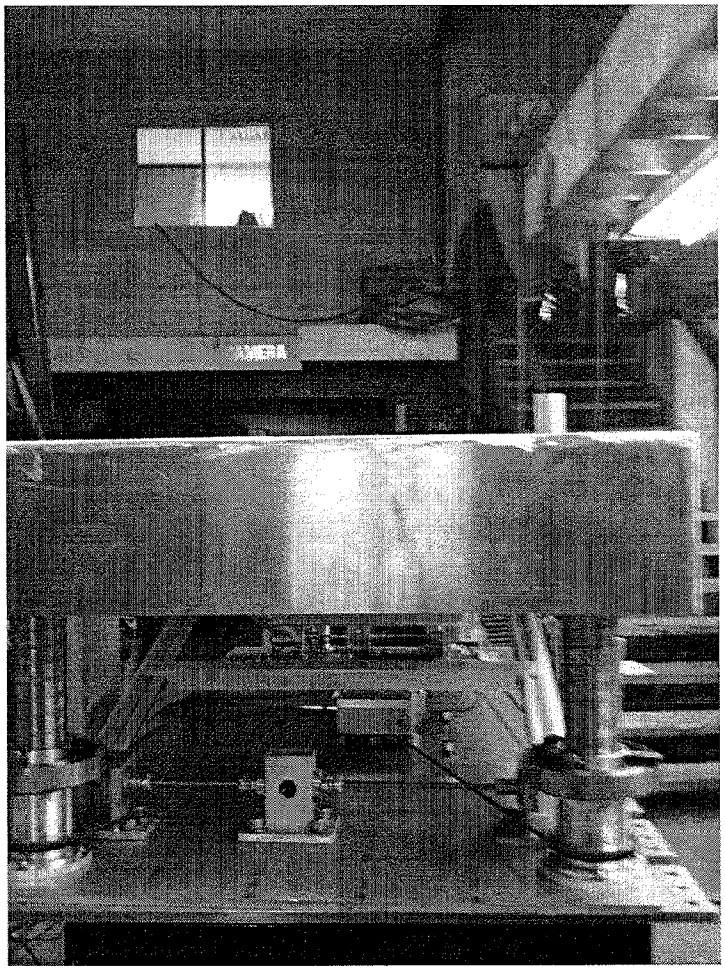
Figure 4L:
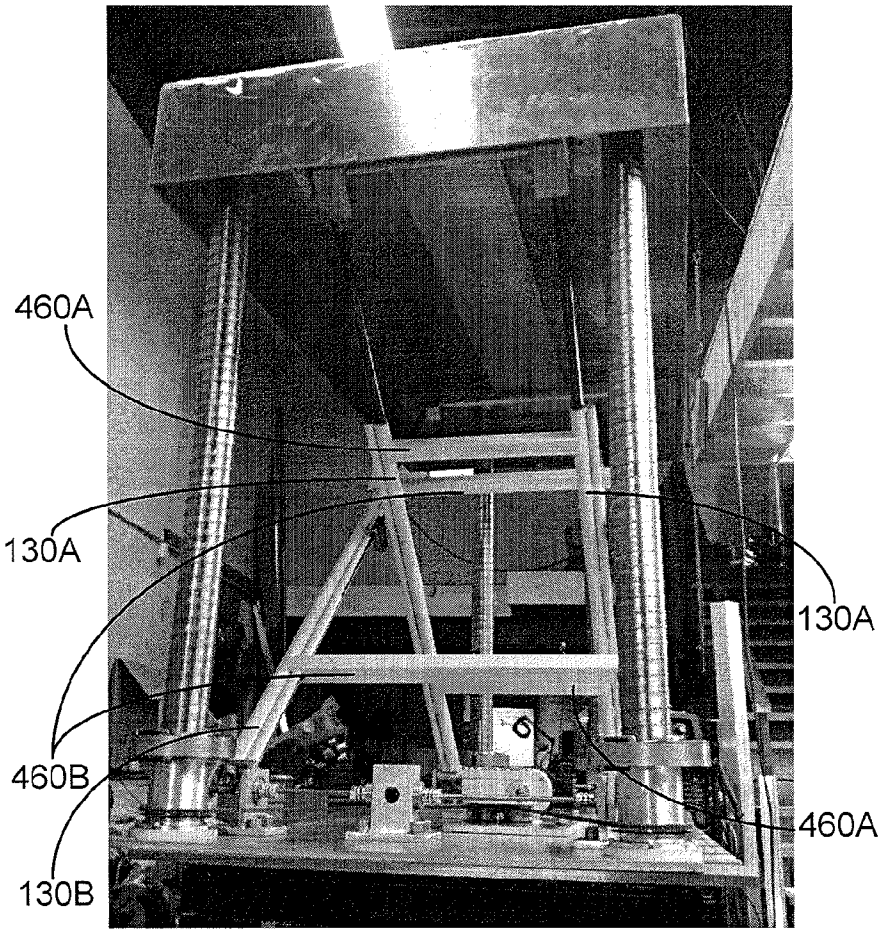
Figure 4K:
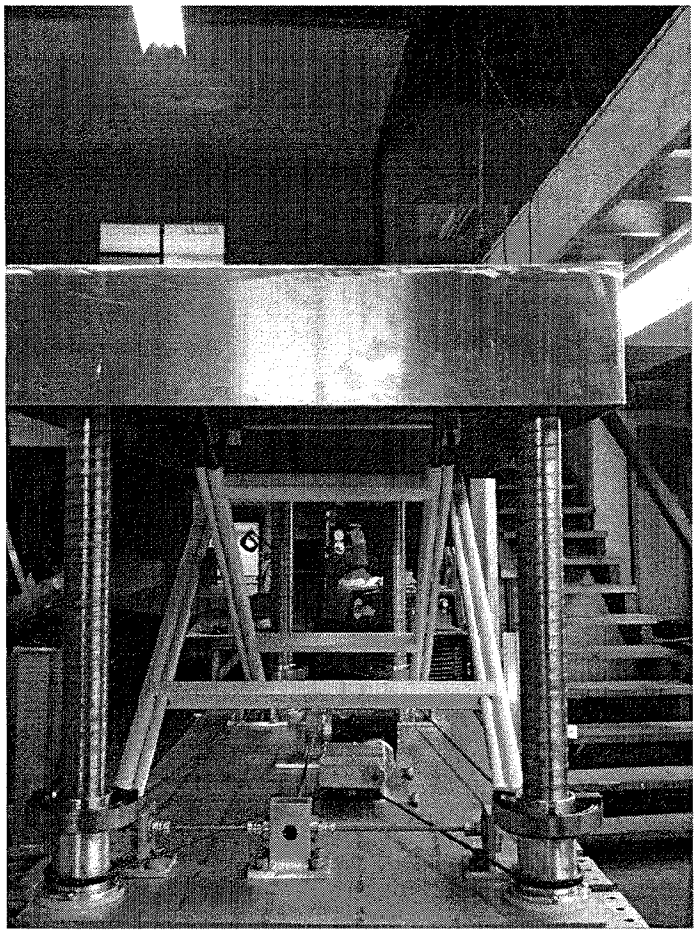
Figure 4M:
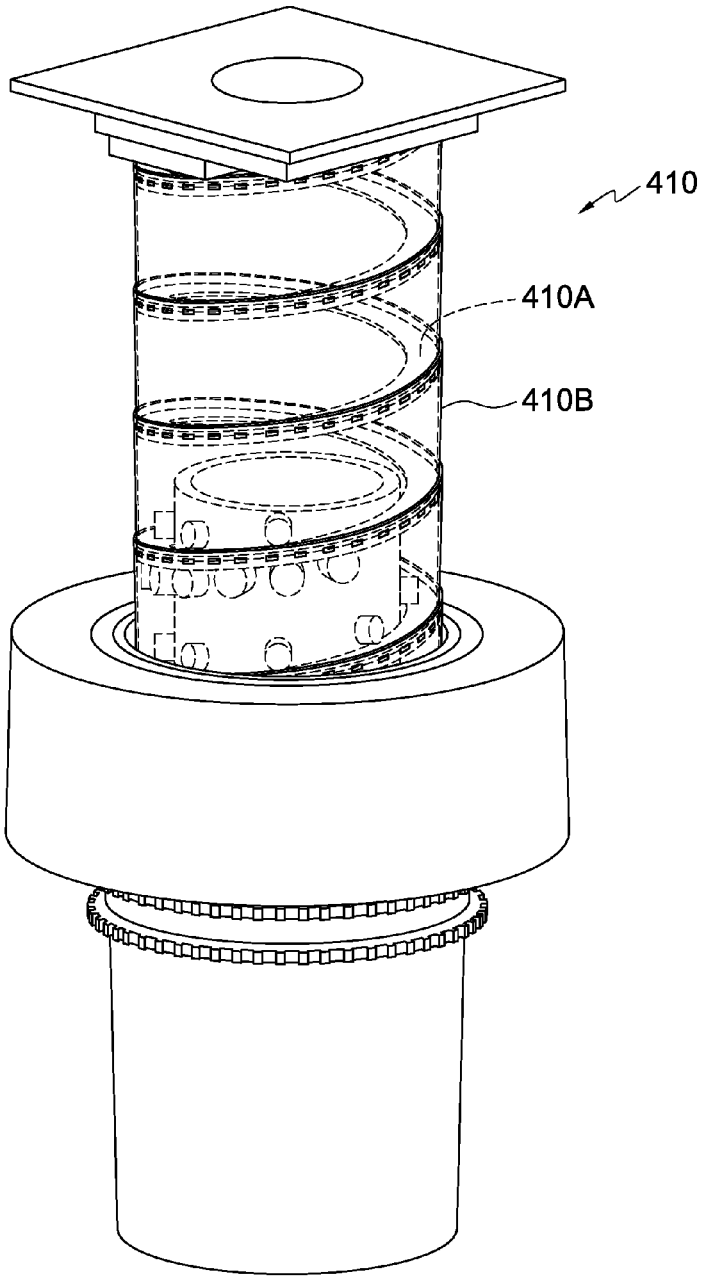
FIG. 4M is a schematic illustration showing an example primary lifting mechanism.

FIGS. 4G-L show another version of a prototype lift assembly 400' moving from a lowered position (FIG. 4G) to a raised position (FIG. 4L). Assembly 400' comprises a cover 450 which covers arms 130 and lifting units 410 in the lowered position, as shown in FIG. 4G. As best seen in FIG. 4L assembly 400' also comprises a pair of cross bars 460A connected between inner arms 130A and another pair of cross bars 460B connected between outer arms 130B to provide increased stability.

Figure 5:
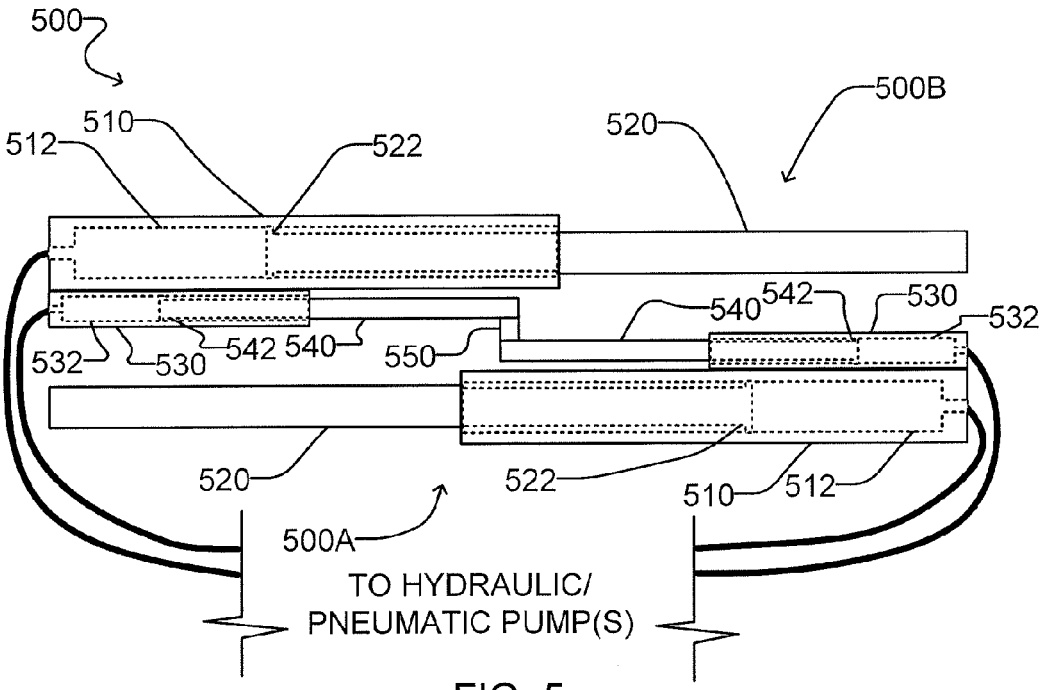
FIG. 5 shows a pair of telescoping arms with a driven pivot according to another example embodiment.

FIG. 5 shows a pair of telescoping arms 500 (individually labeled as inner arm 500A and outer arm 500B) according to another example embodiment. Each arm 500 comprises a base portion 510 and an extension portion 520 which is hydraulically or pneumatically actuated to move in and out of base portion 510 by a drive assembly comprising one or more pumps (not shown). A pivot base portion 530 is attached to base portion 510, and a pivot extension portion 540 is hydraulically or pneumatically actuated to move in and out of pivot base portion 530 by the drive assembly. In the illustrated example, each base portion 510 comprises a base cylinder 512 configured to receive an extension piston 522 of the corresponding extension portion 520, and each pivot base portion 530 comprises a pivot base cylinder 532 configured to receive a pivot extension piston 542 of the corresponding pivot extension portion 540. A pivot assembly 550 is pivotally coupled between pivot extension portions 540 of inner and outer arms 500A and 500B.

Figure 6:
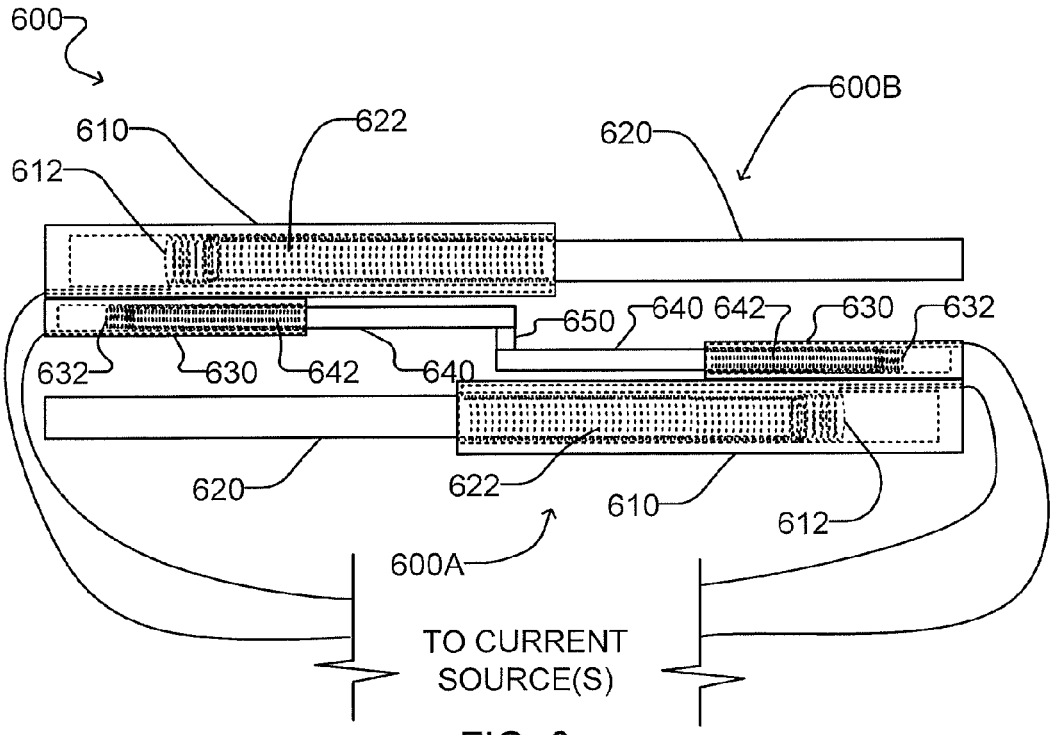
FIG. 6 shows a pair of telescoping arms with a driven pivot according to another example embodiment.

FIG. 6 shows a pair of telescoping arms 600 (individually labeled as inner arm 600A and outer arm 600B) according to another example embodiment. Each arm 600 comprises a base portion 610 and an extension portion 620 which is electromagnetically actuated to move in and out of base portion

610 by a drive assembly comprising one or more current sources (not shown). A pivot base portion 630 is attached to base portion 610, and a pivot extension portion 640 is electromagnetically actuated to move in and out of pivot base portion 630 by the drive assembly. In the illustrated example, each base portion 610 comprises a base coil 612 configured to receive an extension armature 622 of the corresponding extension portion 620, and each pivot base portion 630 comprises a pivot base coil 632 configured to receive a pivot extension armature 642 of the corresponding pivot extension portion 640. A pivot assembly 650 is pivotally coupled between pivot extension portions 640 of inner and outer arms 600A and 600B.

While a number of exemplary aspects and embodiments have been discussed above, those of skill in the art will recognize certain modifications, permutations, additions and sub-combinations thereof. For example, while the example lifts discussed above have a single set of two pairs of telescoping arms between a base and a platform, in other embodiments two or more sets of two pairs of telescoping arms may be connected together in a stack between a base and a platform. For another example, the discussion of the example of FIGS. 4A-F above contemplates separate motors for driving the arms and the lifting units, but it is to be understood that a single motor could be connected through suitable gearing or other linkages to drive the arms and the lifting units. It is therefore intended that the following appended claims and claims hereafter introduced are interpreted to include all such modifications, permutations, additions and sub-combinations as are within their true spirit and scope.

Appendix "A"

THE I-LOCK SPIRALIFT

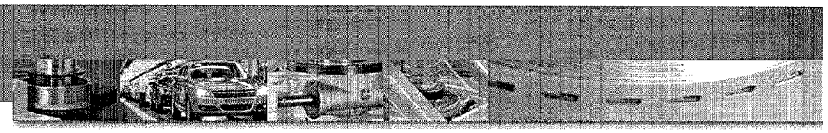

Principle of Operation

The I-Lock Spiralift ILR250 is a linear actuator that is very compact using two stainless steel bands to form a solid lifting column.

The vertical band is stored in a magazine around the ILR250 and the horizontal band is stored below. The vertical band that is perforated is laid over a horizontal band that is toothed with a rotary motion. The horizontal band is raised using a series of cam rollers arranged in a helix pattern. The vertical band is then pushed over the horizontal band. The vertical band is overlapped and the horizontal band perforates the vertical band which then mechanically interlocks both bands creating a solid stainless steel column. This column is raised by the rotary motion of the cam rollers in a helix, much like a ball screw mechanism.

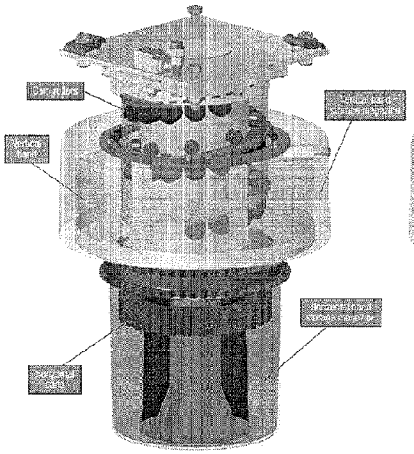

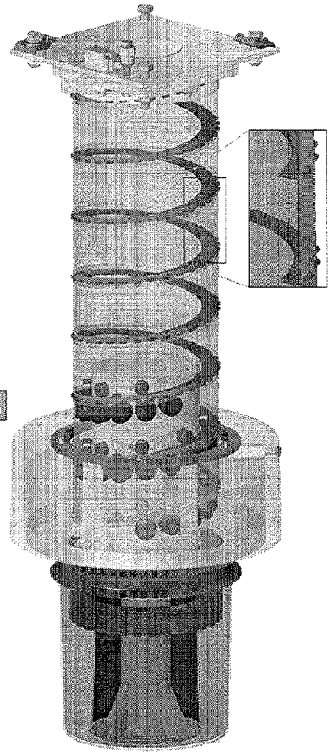

Design Innovation

The completely unique design of this invention is the interlocking of a vertical band with a horizontal band creating a solid stainless steel column. Creating a solid column out of a very compact space which is stable is the unique aspect of this Spiralift. The column is stable and mechanically locked in any direction on the vertical axis as well as in any lateral axes. The column could, therefore, be a push-pull mechanism and has the potential to be run safely without guiding to a certain travel distance.

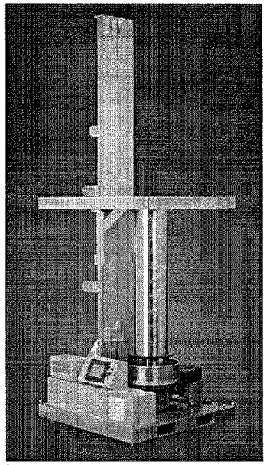

Demonstration unit

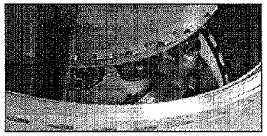

Insertion detail

Advantages

- Stability of the column in all axes in any direction.
- High speed of the column due to the large pitch of the helix at 108mm per revolution.
- High travel distance up to 7.5 m.
- Smooth rotary motion.
- Easy to handle and to install.
- A large static capacity up to 8900 daN.
- Very compact design: 0.674 m closed height for a 6m travel.
- High efficiency up to 78%.
- Low wear/low maintenance.
- Stainless steel bands are non-corrosive.

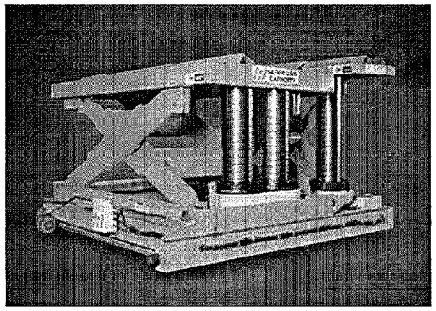

High capacity material handling lift

Appendix "A"

SPECIFICATIONS

I-Lock Spiralift (ILR250)

Technical Parameters

| | | Double Pitch | Single Pitch |
|---|---|---|---|
| Column Diameter | (mm) | 250 Nominal | 250 Nominal |
| Maximum Lifting Capacity | (daN) | 4450 | 2750 |
| Maximum Static Capacity | (daN) | 8900 | 7500 |
| Maximum Static Capacity in tension | (daN) | Up to 1500 | Up to 1500 |
| Maximum travel at reduced load | (m) | 7.5* | 7.5* |
| Maximum speed | (m/sec) | 0.203** | 0.203** |
| Chain Sprocket | | Double chain ANSI RS60-62 teeth | Double Chain ANSI RS60-62 teeth |
| Torque required to lift Maximum load | (Nm) | 980 Nm at sprocket level | 610 Nm at sproket level |
| Permissible vertical misalignment | (degrees) | Up to 1.5° | Up to 1.5° |
| Lift travel per revolution pitch | (mm) | 108 | 108 |
| Column material | | Stainless Steel AISI 301 | Stainless Steel AISI 301 |
| Band dimensions | (mm) | Vertical band: 1.1 x 127 approx.<br>Horizontal band: 4 x 34 approx. | Vertical band: 1.1 x 127 approx.<br>Horizontal band: 4 x 34 approx. |
| Efficiency | (Percentage) | Up to 78% | Up to 78% |
| Closed height at 5m / 6m / 7.5m of travel | | 0.545m / 0.674m / 0.738m | 0.445m / 0.574m / 0.638m |

** See graph*
*** Higher speeds with closed housing in development*

Static & Dynamic Capacity Vs. Spiralift Travel

Double Pitch

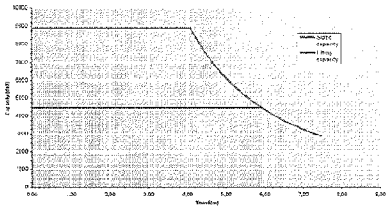

Single Pitch

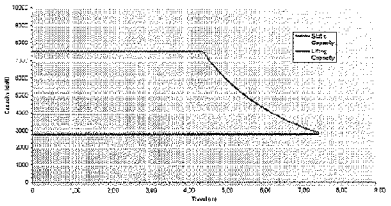

PACO | Spiralift

Head Office
[illegible] Street
Saint-Hubert (Quebec) J3Y 5V6 CANADA
Tel: [illegible]
Fax: [illegible]
[illegible]
Toll-free (North America): [illegible]

www.pacospiralift.com

All marks marked with the ™ symbol are trademarks of Paco Spiralift Inc. its parent company and/or its subsidiaries. All other marks are Other marks are the property of their respective owners. © 2009 Paco Spiralift Inc. All rights reserved worldwide.

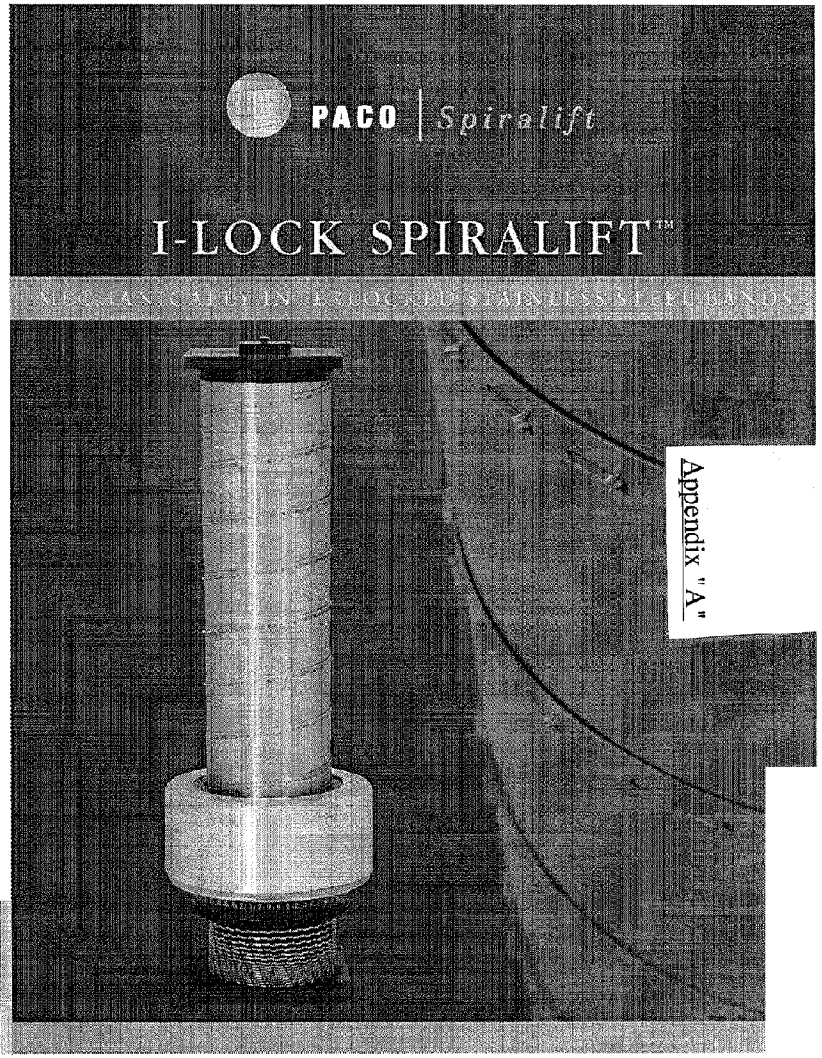

Appendix "A"

PECIFICATIONS

ɔck Spiralift (ILS75)

PRODUCT UNDER DEVELOPMENT
SPECIFICATIONS TO BE CONFIRMED
VERSION SEPTEMBER 2010

ɜchnical Parameters

| | | |
|---|---|---|
| ıensions | (mm) | Column diameter: 75<br>External diameter: 200 |
| ɛimum Lifting Capacity | (daN) | 172 |
| ɛimum Static Capacity | (daN) | 392 |
| ɛimum Travel | (mm) | 1,600* |
| ɛimum Speed | (m/min) | Up to 1.0** |
| Travel per Revolution Pitch | (mm) | 25.4 |
| umn Material | | Vertical band: Stainless Steel AISI 301<br>Horizontal band: AL 7075 |
| d dimensions | (mm) | Vertical band: 0.3 x 32<br>Horizontal band: 1.5 x 9 approx. |
| ɛiency | (Percentage) | Up to 45% |
| sed Height at<br>mm/1,000mm/1,600mm of Travel | | 105 mm / 130 mm / 175 mm |
| ve | | Motor incorporated inside, outside<br>or external chain drive |

*1,200 mm travel at full capacity*
*ravel of 1,600 mm is possible by reducing load*
*Vill depend on the dynamic load and the drive arrangement.*

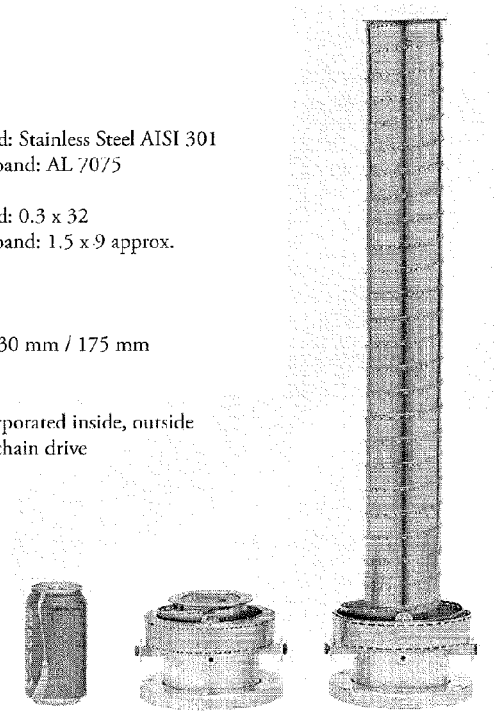

PACO | Spiralift

First Street
-Hubert (Quebec) J3Y 8Y6 CANADA
-1 450 678-7226
-1 450 678-4060 www.pacospiralift.com • spiralift@pacospiralift.com

What is claimed is:

1. An apparatus comprising:

a pair of telescoping arms pivotally coupled between a base and a platform, each arm comprising:

a base portion pivotally coupled to the base to pivot about a base pivot axis;

an extension portion slidably coupled to the base portion and pivotally coupled to the platform to pivot about a platform pivot axis; and, a pivot support assembly attached along a side of one arm of the pair facing toward the other arm of the pair, the pivot support assembly configured to allow longitudinal travel of a pivot anchor with respect to the base portion;

a pivot assembly coupled between the pivot anchors; and, a drive assembly connected to controllably move the extension portions inwardly and outwardly with respect to the corresponding base portions, and controllably move the pivot anchors toward and away from the corresponding base pivot axes.

2. The apparatus according to claim 1 wherein the drive assembly is connected to move the extension portions inwardly and outwardly with respect to the base portions at a first speed, and move the pivot anchors toward and away from the base pivot axes at a second speed which is one half of the first speed.

3. The apparatus according to claim 1 wherein the drive assembly comprises, for each arm, an extension leadscrew extending through the base portion and an extension nut coupled to the extension portion, wherein the extension leadscrew is threadedly received in the extension nut such that rotation of the extension leadscrew in a first direction causes the extension portion to move outwardly with respect to the base portion and rotation of the extension leadscrew in an opposite direction causes the extension portion to move inwardly with respect to the base portion.

4. The apparatus according to claim 3 wherein, for each arm, the pivot support assembly comprises a pivot drive casing and wherein the drive assembly comprises a pivot leadscrew extending through the pivot drive casing and a pivot anchor nut coupled to the pivot assembly, wherein the pivot leadscrew is threadedly received in the pivot anchor nut such that rotation of the pivot leadscrew in a first direction causes the pivot anchor nut to move away from the base pivot axis and rotation of the pivot leadscrew in an opposite direction causes the pivot anchor nut to move toward the base pivot axis.

5. The apparatus according to claim 4 wherein the extension leadscrew has an extension bevel gear attached to a lower end thereof and the pivot leadscrew has and a pivot bevel gear attached to a lower end thereof.

6. The apparatus according to claim 5 wherein the drive assembly comprises, for each arm, a first driving bevel gear configured to engage the extension bevel gear and a second driving bevel gear configured to engage the pivot bevel gear, wherein the first and second bevel gears are attached to a common shaft.

7. The apparatus according to claim 5 wherein the drive assembly comprises, for each arm, a first driving bevel gear configured to engage the extension bevel gear and a second driving bevel gear configured to engage the pivot bevel gear, wherein the first and second bevel gears are respectively attached to first and second shafts.

8. The apparatus according to claim 7 wherein the first and second shafts are concentric, wherein one of the first and second shafts has a central cavity and the other of the first and second shafts is rotatable within the central cavity.

9. The apparatus according to claim 1 wherein the extension portion of each arm comprises a first extension portion slidably coupled to the base portion and a second extension portion slidably coupled to the first extension portion and pivotally coupled to the platform.

10. The apparatus according to claim 9 wherein, for each arm, the pivot support assembly comprises a pivot support arm attached to the first extension portion, wherein the pivot support arm has a linear bearing thereon configured to ride along an exterior of the base portion.

11. The apparatus according to claim 9 wherein the drive assembly comprises, for each arm:

a first extension leadscrew extending through the base portion and threadedly received in a first extension nut coupled to the first extension portion, the first extension leadscrew having a plurality of longitidinal slots through helical threads thereof;

a first gear pivotally mounted to a bottom of the first extension portion configured to be engaged by the longitudinal slots of the first extension leadscrew;

a second extension leadscrew mounted on a second gear configured to engage the first gear, the second extension leadscrew extending through the first extension portion and threadedly received in a second extension nut coupled to the second extension portion.

12. The apparatus according to claim 9 wherein the drive assembly comprises, for each arm:

a first extension leadscrew extending through the base portion and threadedly received in a first extension nut coupled to the first extension portion, the first extension leadscrew having at least one longitudinal keyway therein;

a first extension gear having an aperture defined therein to match a cross-sectional profile of the first extension leadscrew slidably mounted on the first extension leadscrew, the first extension gear configured to rotate with the first extension leadscrew;

a second extension leadscrew mounted on a second gear pivotally mounted to a bottom of the first extension portion, the second gear configured to engage the first extension gear, the second extension leadscrew extending through the first extension portion and threadedly received in a second extension nut coupled to the second extension portion.

13. The apparatus according to claim 1 wherein the pivot support assembly for each arm comprises a pivot base portion and a pivot extension portion longitudinally moveable with respect to the pivot base portion, wherein the drive assembly comprises a cylinder in each of the base portions and the pivot base portions and an associated piston received therein on each of the corresponding extension portions and pivot extension portions.

14. The apparatus according to claim 1 wherein the pivot support assembly for each arm comprises a pivot base portion and a pivot extension portion longitudinally moveable with respect to the pivot base portion, wherein the drive assembly comprises a coil in each of the base portions and the pivot base portions and an associated armature received therein on each of the corresponding extension portions and pivot extension portions.

15. The lift comprising:

a base;

a platform;

two pairs of telescoping arms pivotally coupled between the base and the platform, each arm of each pair comprising:

a base portion pivotally coupled to the base to pivot about a base pivot axis;

an extension portion slidably coupled to the base portion and pivotally coupled to the platform to pivot about a platform pivot axis; and, a pivot support assembly attached along a side of one arm of the pair facing toward the other arm of the pair, the pivot support assembly configured to allow longitudinal travel of a pivot anchor with respect to the base portion;

two pivot assemblies, each pivot assembly coupled between the pivot anchors of one of the pairs of telescoping arms; and a drive assembly connected to controllably move the extension portions inwardly and outwardly with respect to the corresponding base portions, and controllably move the pivot anchors toward and away from the corresponding base pivot axes.

16. The lift according to claim 15 wherein the arms are configured to be at an angle of at least about 10 degrees with respect to the base when the platform is in a lowered position.

17. The lift according to claim 15 comprising one or more biasing mechanisms configured to urge the arms upwardly when the arms are at an angle of less than about 10 degrees with respect to the base.

18. The lift according to claim 15 comprising one or more primary lifting mechanisms coupled between the base and the platform, the primary lifting mechanisms configured to selectively provide upward vertical force for raising the platform.

19. The lift according to claim 18 wherein the primary lifting mechanisms each comprise a coiled flexible flat spring which expands with insertion of a vertically oriented spiral band.

20. The lift according to claim 15 wherein each pair of arms comprises an inner arm and an outer arm, comprising a truss structure connected between the inner arms.

21. The lift according to claim 15 wherein the drive assembly is connected to move the extension portions inwardly and outwardly with respect to the base portions at a first speed, and move the pivot anchors toward and away from the base pivot axes at a second speed which is one half of the first speed.

22. The lift according to claim 15 wherein the drive assembly comprises, for each arm, an extension leadscrew extending through the base portion and an extension nut coupled to the extension portion, wherein the extension leadscrew is threadedly received in the extension nut such that rotation of the extension leadscrew in a first direction causes the extension portion to move outwardly with respect to the base portion and rotation of the extension leadscrew in an opposite direction causes the extension portion to move inwardly with respect to the base portion.

23. The lift according to claim 22 wherein, for each arm, the pivot support assembly comprises a pivot drive casing and wherein the drive assembly comprises a pivot leadscrew extending through the pivot drive casing and a pivot anchor nut coupled to the pivot assembly, wherein the pivot leadscrew is threadedly received in the pivot anchor nut such that rotation of the pivot leadscrew in a first direction causes the pivot anchor nut to move away from the base pivot axis and rotation of the pivot leadscrew in an opposite direction causes the pivot anchor nut to move toward the base pivot axis.

24. The lift according to claim 23 wherein the extension leadscrew has an extension bevel gear attached to a lower end thereof and the pivot leadscrew has and a pivot bevel gear attached to a lower end thereof.

25. The lift according to claim 24 wherein the drive assembly comprises, for each arm, a first driving bevel gear configured to engage the extension bevel gear and a second driving bevel gear configured to engage the pivot bevel gear, wherein the first and second bevel gears are attached to a common shaft.

26. The lift according to claim 24 wherein the drive assembly comprises, for each arm, a first driving bevel gear configured to engage the extension bevel gear and a second driving bevel gear configured to engage the pivot bevel gear, wherein the first and second bevel gears are respectively attached to first and second shafts.

27. The lift according to claim 26 wherein the first and second shafts are concentric, wherein one of the first and second shafts has a central cavity and the other of the first and second shafts is rotatable within the central cavity.

28. The lift according to claim 15 wherein the extension portion of each arm comprises a first extension portion slidably coupled to the base portion and a second extension portion slidably coupled to the first extension portion and pivotally coupled to the platform.

29. The lift according to claim 28 wherein, for each arm, the pivot support assembly comprises a pivot support arm attached to the first extension portion, wherein the pivot support arm has a linear bearing thereon configured to ride along an exterior of the base portion.

30. The lift according to claim 28 wherein the drive assembly comprises, for each arm:

a first extension leadscrew extending through the base portion and threadedly received in a first extension nut coupled to the first extension portion, the first extension leadscrew having a plurality of longitidinal slots through helical threads thereof;

a first gear pivotally mounted to a bottom of the first extension portion configured to be engaged by the longitudinal slots of the first extension leadscrew;

a second extension leadscrew mounted on a second gear configured to engage the first gear, the second extension leadscrew extending through the first extension portion and threadedly received in a second extension nut coupled to the second extension portion.

31. The lift according to claim 28 wherein the drive assembly comprises, for each arm:

a first extension leadscrew extending through the base portion and threadedly received in a first extension nut coupled to the first extension portion, the first extension leadscrew having at least one longitudinal keyway therein;

a first extension gear having an aperture defined therein to match a cross-sectional profile of the first extension leadscrew slidably mounted on the first extension leadscrew, the first extension gear configured to rotate with the first extension leadscrew;

a second extension leadscrew mounted on a second gear pivotally mounted to a bottom of the first extension portion, the second gear configured to engage the first extension gear, the second extension leadscrew extending through the first extension portion and threadedly received in a second extension nut coupled to the second extension portion.

32. The lift according to claim 15 wherein the pivot support assembly for each arm comprises a pivot base portion and a pivot extension portion longitudinally moveable with respect to the pivot base portion, wherein the drive assembly comprises a cylinder in each of the base portions and the pivot base portions and an associated piston received therein on each of the corresponding extension portions and pivot extension portions.

33. The lift according to claim 15 wherein the pivot support assembly for each arm comprises a pivot base portion and a pivot extension portion longitudinally moveable with respect to the pivot base portion, wherein the drive assembly comprises a coil in each of the base portions and the pivot base portions and an associated armature received therein on each of the corresponding extension portions and pivot extension portions.

34. The lift according to claim 15 wherein the two pairs of telescoping arms comprise two or more stacked sets of pivotally coupled between the base and the platform.

* * * * *